US008379889B2

(12) United States Patent
Feilner et al.

(10) Patent No.: US 8,379,889 B2
(45) Date of Patent: Feb. 19, 2013

(54) METHOD OF OPERATING A HEARING DEVICE AND A HEARING DEVICE

(75) Inventors: Manuela Feilner, Herrliberg (CH); Andrea Brueckner, Zurich (CH); Sascha Korl, Schonenberg (CH)

(73) Assignee: Phonak AG, Stafa (CH)

( * ) Notice: Subject to any disclaimer, the term of this patent is extended or adjusted under 35 U.S.C. 154(b) by 276 days.

(21) Appl. No.: 12/743,597

(22) PCT Filed: Nov. 23, 2007

(86) PCT No.: PCT/EP2007/062767

§ 371 (c)(1), (2), (4) Date: May 19, 2010

(87) PCT Pub. No.: WO2008/031901

PCT Pub. Date: Mar. 20, 2008

(65) Prior Publication Data

US 2010/0272298 A1 Oct. 28, 2010

(51) Int. Cl.
*H04R 25/00* (2006.01)

(52) U.S. Cl. ..... 381/190; 381/312

(58) Field of Classification Search ..... 381/190, 381/312

See application file for complete search history.

(56) References Cited

U.S. PATENT DOCUMENTS

| | | | | |
|---|---|---|---|---|
| 5,824,022 | A * | 10/1998 | Zilberman et al. | 607/57 |
| 6,633,645 | B2 | 10/2003 | Bren et al. | |
| 6,760,457 | B1 | 7/2004 | Bren et al. | |
| 7,010,132 | B2 * | 3/2006 | Luo et al. | 381/312 |
| 7,016,510 | B2 * | 3/2006 | Arndt et al. | 381/312 |
| 2009/0060243 | A1 * | 3/2009 | Michaelis | 381/331 |
| 2009/0264789 | A1 * | 10/2009 | Molnar et al. | 600/544 |

FOREIGN PATENT DOCUMENTS

| | | | |
|---|---|---|---|
| EP | 1443803 | A2 | 8/2004 |
| EP | 1662841 | A2 | 5/2006 |

OTHER PUBLICATIONS

International Search Report for PCT/EP2007/062767 dated Feb. 27, 2008.

Written Opinion for for PCT/EP2007/062767 dated Feb. 27, 2008.

* cited by examiner

*Primary Examiner* — Forrest M Phillips

(74) *Attorney, Agent, or Firm* — Pearne & Gordon LLP

(57) ABSTRACT

A method of operating a hearing device is disclosed, the method comprising the steps of:

sensing an acoustic signal and providing an input acoustic signal, sensing a magnetic signal and providing a input magnetic signal, selecting one of the input acoustic signal and the input magnetic signal as an information signal, wherein the input magnetic signal or the input acoustic signal is selected as the information signal after a signal detection process has determined a probability being above a pre-set value, said probability being indicative of a presence of audio information in the input magnetic signal or the input acoustic signal, respectively, and processing the information signal and providing an output signal to a user of the hearing device.

In addition, corresponding hearing devices are also disclosed.

16 Claims, 2 Drawing Sheets

METHOD OF OPERATING A HEARING DEVICE AND A HEARING DEVICE

The present invention is directed to a method of operating a hearing device as well as to a hearing device.

Automatic telephone detection allows a hearing device to switch to an appropriate hearing program when a telephone conversation is detected.

Currently, the telephone conversation is detected by monitoring a signal transmitted via a so-called T-coil. If a magnetic field sensed by the T-coil is high enough a trigger is activated. Most telephones however do not produce a strong enough magnetic field by themselves. A common solution is therefore to attach an additional magnet to the telephone which is then used to trigger the T-Coil signal detector. In U.S. Pat. No. 6,633,645 and U.S. Pat. No. 6,760,457, a known hearing device is described having a magnetic sensor for detecting a magnetic field close to the hearing device. The output of the magnetic sensor is used to switch the hearing device to a telephone mode, in which a specific hearing program is activated.

Recently more sensitive detection devices have been introduced that often work without additional magnets. However, these detection devices are still not very reliable.

For example, U.S. Pat. No. 7,010,132 describes a hearing device that analyses the signal output of a magnetic field detector to determine whether an acoustic signal is present in the magnetic field.

This solution is generally not very desirable as it requires the user to modify the telephone.

Furthermore, U.S. Pat. No. 7,016,510 describes a method for switching a hearing device to a telephone mode based on two hearing devices worn on the left and on the right side. A signal from one hearing device is compared to a signal from the other hearing device and a decision is based on the difference between the two signals. This solution does only work if two hearing devices are present.

An object of the present invention is therefore to provide a method for operating a hearing device that is very reliable and simple to implement, in particular without the need to adapt the hardware of the hearing device.

This and other objects have been reached by the features of claim 1. Advantageous embodiments of the present invention as well as a hearing device are given in further claims.

The present invention is directed to a method of operating a hearing device, the method comprising the steps of:

- sensing an acoustic signal and providing an input acoustic signal,
- sensing a magnetic signal and providing a input magnetic signal,
- selecting one of the input acoustic signal and the input magnetic signal as an information signal, wherein the input magnetic signal is selected as the information signal after a signal detection process has determined a probability being above a preset value, said probability being indicative of a presence of audio information in the input magnetic signal, and
- processing the information signal and providing an output signal to a user of the hearing device.

Furthermore, the present invention is also directed to a method of operating a hearing device, the method comprising the steps of:

- sensing an acoustic signal and providing an input acoustic signal,
- sensing a magnetic signal and providing a input magnetic signal,

- selecting one of the input acoustic signal and the input magnetic signal as an information signal, wherein the input acoustic signal is selected as the information signal after a signal detection process has determined a probability being above a preset value, said probability being indicative of a presence of audio information in the input acoustic signal, and
- processing the information signal and providing an output signal to a user of the hearing device.

Embodiments of the present invention further comprise the step of determining the probability using at least one of the following criterions:

- a bandwidth of the input magnetic signal is below a predefined value, in particular below 3 kHz;
- a bandwidth of the input acoustic signal is below a predefined value, in particular below 3 kHz;
- a telephone dial tone has been detected;
- a behavior of a feedback canceller filter is due to an object being close to an ear;
- a magnetic field is detected in a T-coil.

In further embodiments of the present invention, the step of selecting one of the input acoustic signal and the input magnetic signal as the information signal is using a state machine.

In other embodiments, the state machine comprises at least four states comprising:

- an Idle state being a default state;
- an DialTone state being representative for detecting dial tone;
- a Listen state being representative for receiving acoustic information from a remote person talking via telephone;
- a Speak state being representative for speaking to a remote person via telephone.

The present invention is also directed to a hearing device comprising:

- an acoustic sensor for sensing an acoustic signal and providing an input acoustic signal,
- a magnetic sensor for sensing a magnetic field signal and providing an input magnetic signal,
- a telephone detection unit connected to the magnetic sensor for selecting one of the input acoustic signal and the input magnetic signal as an information signal, wherein the telephone detector unit selects the input magnetic signal as the information signal after a telephone detection process has determined a probability being above a preset value, said probability being indicative of a presence of audio information in the input magnetic signal, and
- an information processing unit (8) for processing the information signal to a user of the hearing device.

Furthermore, the present invention is also directed to a further hearing device comprising:

- an acoustic sensor for sensing an acoustic signal and providing an input acoustic signal,
- a magnetic sensor for sensing a magnetic field signal and providing an input magnetic signal,
- a telephone detection unit connected to the acoustic sensor for selecting one of the input acoustic signal and the input magnetic signal as an information signal, wherein the telephone detector unit selects the input magnetic signal as the information signal after a telephone detection process has determined a probability being above a preset value, said probability being indicative of a presence of audio information in the input magnetic signal, and
- an information processing unit for processing the information signal to a user of the hearing device.

In further embodiments of the present invention, the hearing device further comprises a switch unit for operationally connecting either the magnetic sensor or the acoustic sensor to the information processing unit, the switch unit being controllable by the telephone detection unit.

In further embodiments of the present invention, the hearing device further comprises a state machine in the telephone detection unit.

In still further embodiments of the present invention, the state machine comprises at least four states comprising:

- an Idle state being a default state;
- an DialTone state being representative for detecting dial tone;
- a Listen state being representative for receiving acoustic information from a remote person talking via telephone; and
- a Speak state being representative for speaking to a remote person via telephone.

This invention enables a hearing device to recognize when the user is talking on the phone using mainly acoustic features. No additional hardware is necessary in the hearing device. This is desirable, as any hardware components will take up space and increase the power consumption of the hearing device. A software based solution is highly preferred. The traditional T-Coil (or an equivalent device) can contribute to the detection, but is not essential.

A preferred solution as described here does not require any hardware modification of neither telephone nor hearing aid.

The present invention will be further described by referring to drawings showing exemplified embodiments of the present invention.

Figure 1:
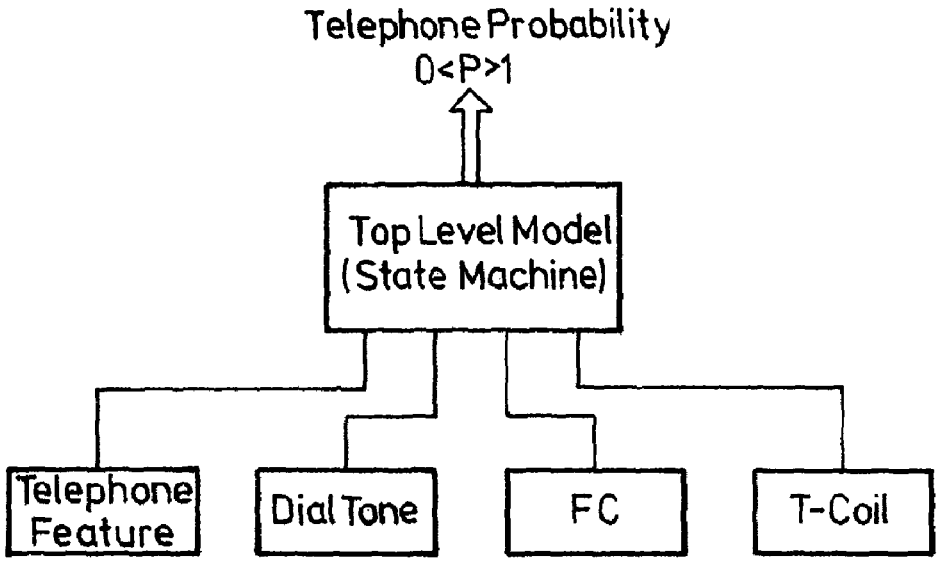
FIG. 1 shows an overview of a signal flow for a telephone detection system according to the present invention.

FIG. 1 shows a signal flow for a telephone detection system that is implemented in a hearing device. The telephone detection system is not only useful to detect a telephone conversation but can also readily be used to prepare the hearing device when a telephone call is likely to occur. This means that the telephone detection system is monitoring a momentary acoustic situation by applying specific criterions or so called characteristic features, which give an indication on whether a telephone conversation is likely to occur.

The detection of a telephone conversation is in particular important since it allows the hearing device to operate in a hearing program that is optimized for such an acoustic situation. Similarly, the prediction of a telephone conversation allows the hearing device to switch to a hearing program before the telephone conversation has started. Therewith, other acoustic signals that do not belong to the telephone conversation can be eliminated.

The specific characteristic features, which are selected in order to perform the required task, form the basis in a signal detection process conducted in the hearing device. In fact, the signal detection process combines different characteristic features to determine an overall probability being indicative of a presence of audio information. The audio information can come from different source, such as, for example, the microphone built into or connected to the hearing device, or a so called T-coil—again possibly incorporated into the hearing device—that is used to pick up a magnetic field that contains the audio information. In a particular situation, a microphone as acoustic sensing means and a T-coil as magnetic sensing means are both provided. Usually, audio information of the acoustic sensing means are fed to a signal processing unit that performs the signal processing algorithms commonly implemented in a hearing device, while the magnetic sensing means provide a magnetic audio signal that is subject to the telephone detection process. As soon as, by applying the yet to describe characteristic features, audio information is detected in the input magnetic signal, the input acoustic signal presently processed in the signal processing unit is replaced by the input magnetic signal. The input magnetic signal now contains the relevant audio information that is further processed in the signal processing unit, and, after the processing, is provided to the user of the hearing device.

A telephone situation (conversation, prediction) will cause several characteristic effects. Any of those characteristic effects may be caused by situations other than a telephone conversation. The aim is to detect a combination of those characteristic effects. For example, an acoustic characteristic effect is the limited bandwidth of telephone speech. Therefore, a first characteristic feature is the bandwidth that is monitored. Although the sole monitoring of the bandwidth is not sufficient to reliably detect a telephone conversation. In addition, it must be taken into account that the bandwidth is not limited when the user of the hearing device is talking because the own voice is not band limited. In this case, the monitoring of an additional characteristic feature may be necessary in order to reliably detect the telephone conversation or the audio information in the input magnetic signal.

Further characteristic features are the following, for example:

- Detection of a dial tone that usually is at 425 Hz;
- Behavior of a feedback canceller present in the hearing device is observed: an object that is close to the hearing device must result in a change in the feedback filter coefficients;
- Detection of a magnetic field that is close to the microphone.

The number and the kind of characteristic features is not limited. In fact, the more characteristic features are taken into account, the better the result of the detection of a telephone conversation will be.

In one embodiment of the present invention, a state machine is used to combine all the characteristic features in order to determine the probability for a telephone conversation at any point in time.

FIG. 1 shows an overview of such a telephone detection system in a block diagram. The characteristic features which are to be monitored can be seen on the lower level of the block diagram, according to which the characteristic features as the bandwidth, the dial tone, the feedback canceller and the activity of the T-coil is monitored. The results of the monitoring of the characteristic features are provided as input signals to a so called top-level model by that an overall telephone probability is determined. The top-level model is implemented as a so called state machine, for example.

The characteristic features as mentioned above are further described in more detail in the following:

Classifier Telephone Feature

Telephone speech is typically limited to a bandwidth of 3 kHz. An input signal with such a bandwidth can be detected.

Dial Tone

The telephone dial tone has an international standard pitch of 425 Hz. The dial tone having consecutive tones of this frequency can therefore be detected.

Feedback Canceller: Object Detection

The feedback canceller contains an adaptive filter that follows the feedback path from receiver to the microphone of a hearing device. The feedback path can change dramatically if an object is brought close to the ear with the hearing device. By monitoring the behavior of the filter of the feedback canceller, it is possible to detect when an object, such as a telephone, is close to the microphone of the hearing device.

T-Coil

The T-Coil detects a magnetic field near the hearing device. If the magnetic field strength reaches a certain threshold a switch is activated. This can be used as an additional characteristic feature.

Figure 2:
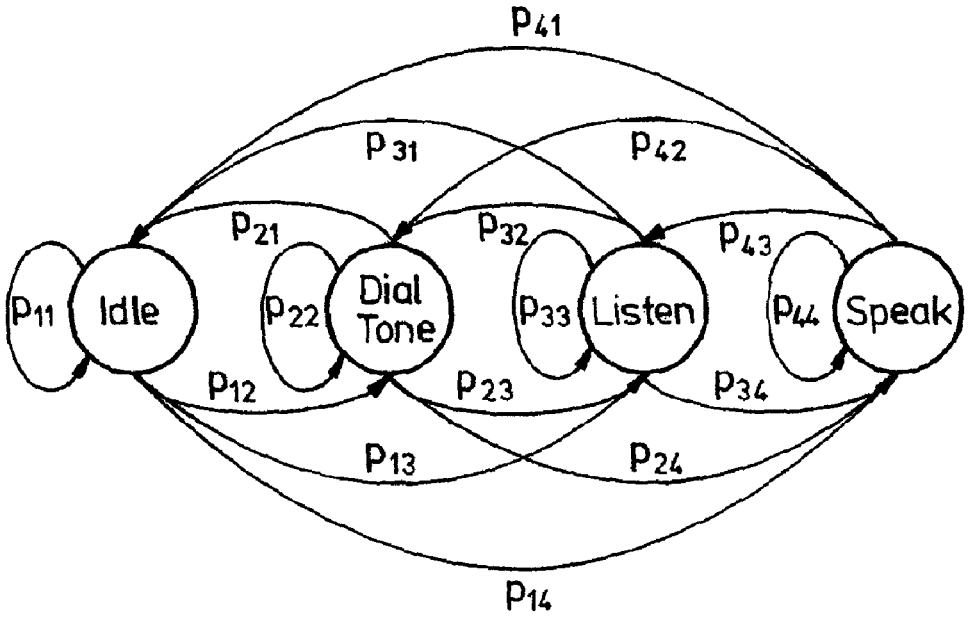
FIG. 2 shows a diagram of a state machine implemented in a hearing device.

It has already been mentioned that the top-level model is, according to one embodiment, implemented as a state machine. Such as state machine is depicted in FIG. 2 and has four states.

The purpose of the state machine is to combine the results of monitoring the characteristic features to determine the overall possibility of a telephone conversation. In one embodiment, the state machine has four states as follows:

1. Idle
2. Dial Tone
3. Listen
4. Speak

These four states correspond to the situations the hearing device can be in. The default state is "Idle", during which the hearing device is in a normal hearing situation. The last three states correspond to a telephone situation. During a telephone conversation the user can be either speaking or listening, or can be listening to a dial tone at the beginning of a conversation. At any point in time m, every state has a certain probability associated to it that indicates how likely it is that the hearing device is in the corresponding acoustic situation. The sum of all states is always equal to 1. The four probabilities are expressed as a vector:

$$\overline{P_{\text{Total}}(m)}=[p_{Idle}p_{DialTone}p_{Listen}p_{Speak}]$$

The overall telephone probability is the sum of the states two, three and four, i.e.

$$P_{Telephone}=p_{DialTone}+p_{Listen}+p_{Speak}$$

Similarly, every characteristic feature has associated to it a four-element probability vector. The probabilities in the vector change according to whether the characteristic feature changes or not. For example, if the "Dial Tone" characteristic feature is detected, its probability vector will have a high probability for the "Dial Tone" state and a low probability for every other state.

At every point in time, the probability vector is updated. The update occurs according to the newest input from the characteristic feature monitoring and the transition probabilities between the states ($p_{xy}$ in FIG. 2). The transition probabilities are a design parameter and remain fixed during operation. Since there are four states, the transition probabilities can be written in a four-by-four matrix A according to:

$$A=\begin{bmatrix} p_{11} & p_{12} & p_{13} & p_{14} \\ p_{21} & p_{22} & p_{23} & p_{24} \\ p_{31} & p_{32} & p_{33} & p_{34} \\ p_{41} & p_{42} & p_{43} & p_{44} \end{bmatrix}$$

Every element of the matrix indicates the probability of a transition between two states. For example, $p_{12}$ denotes the probability of a transition from state 1 to state 2, $p_{31}$ a transition from state 3 to state 1, and so on.

Figure 3:
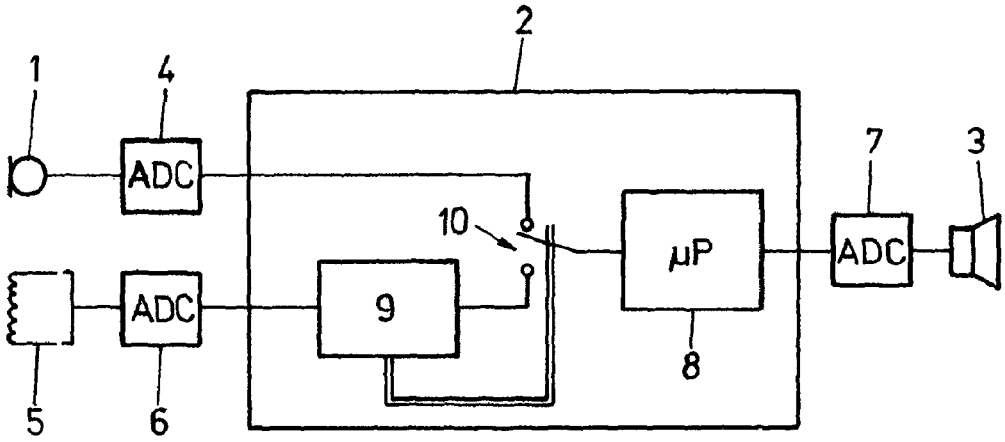
FIG. 3 shows a hearing device according to the present invention.

In FIG. 3, a hearing device according to the present invention is depicted. The hearing device comprises a microphone 1, a signal processing unit 2, a loudspeaker 3, a T-coil 5, two analog-to-digital converters 4 and 6 and a digital-to-analog converter 7. The signal processing unit 2 comprises a telephone detection unit 9, a switching unit 10 and an information processing unit 8. The microphone 1 is an acoustic sensing unit for sensing an acoustic signal and for providing an input acoustic signal to the analog-to-digital converter 4 that is connected to the signal processing unit 2. The T-coil 5 is a magnetic sensing unit for sensing a magnetic signal and for providing an input magnetic signal to the analog-to-digital converter 6 that is also connected to the signal processing unit 2. In the signal processing unit 2, an information signal is determined based on the input acoustic signal and the input magnetic signal, the information signal being processed in the information processing unit 8, which provides an output signal to a user of the hearing device via digital-to-analog converter 7 and loudspeaker 3.

In accordance with the telephone detection process described above, the telephone detection unit 9 monitors the input magnetic signal provided by the T-coil 5. Basically, the telephone detection unit 9 monitors the characteristic features described in connection with the telephone detection process, i.e. as soon as a determined probability reaches a predetermined threshold level indicating that a telephone conversation is most likely or indicating that a telephone call is most likely to happen, the switching unit 10 is activated in such a manner that the input magnetic signal is fed to the information processing unit 8, in which algorithms to improve the hearing of the hearing device user are applied. In fact, the input signal to the information processing unit 8—also called the information signal—is equal to the input acoustic signal in cases were the determined probability lies below the predetermined threshold, and is equal to the input magnetic signal in cases were the determined probability is equal to the predetermined threshold or lies above the predetermined threshold.

Having discloses the structure of an implementation of the inventive hearing device, it is noted that some of the tasks which have been assigned to individual blocks in the block diagram of FIG. 3, can readily implemented as software routines performing the assigned task. In particular, the telephone detection unit 9 could also be seen as means implementing the telephone detection process described in connection with the inventive method.

In a further embodiment of the present invention, the telephone detection unit 9 is incorporated into the signal path carrying the input acoustic signal, and not into the signal path carrying the input magnetic signal as shown in FIG. 3. Accordingly, this embodiment of the present invention allows to base the telephone detection process on the input acoustic signal, which is advantageous in cases were no or only a weak input magnetic signal can be received.

Although a T-coil 5 is disclosed in the various embodiments shown above, other methods or devices can be used for transmitting a telephone signal to the hearing device. Other than a magnetic transmission, as for example it is the case with a T-coil, a transmission via Bluetooth or other transmission protocols can also be used.

What is claimed is:

1. A method of operating a hearing device, the method comprising the steps of:

sensing an acoustic signal and providing an input acoustic signal, sensing a magnetic signal and providing an input magnetic signal, selecting one of the input acoustic signal and the input magnetic signal as an information signal, wherein the input magnetic signal is selected as the information signal after a signal detection process has determined a probability being above a preset value, said probability being indicative of a presence of audio information in the input magnetic signal, and processing the information signal and providing an output signal to a user of the hearing device, wherein the probability is determined by monitoring a bandwidth of the input magnetic signal and by monitoring at least one of the following criterions:

presence of a telephone dial tone;

behavior of a feedback canceller filter indicating an object being close to an ear; and a magnetic field is present in a T-coil.

2. The method of claim 1, wherein the step of selecting one of the input acoustic signal and the input magnetic signal as the information signal is performed using a state machine.

3. The method of claim 2, wherein the state machine comprises at least four states comprising:

an Idle state being a default state;

an DialTone state being representative for detecting dial tone;

a Listen state being representative for receiving acoustic information from a remote person talking via telephone;

a Speak state being representative for speaking to a remote person via telephone.

4. A method of operating a hearing device, the method comprising the steps of:

sensing an acoustic signal and providing an input acoustic signal, sensing a magnetic signal and providing an input magnetic signal, selecting one of the input acoustic signal and the input magnetic signal as an information signal, wherein the input acoustic signal is selected as the information signal after a signal detection process has determined a probability being above a preset value, said probability being indicative of a presence of audio information in the input acoustic signal, and processing the information signal and providing an output signal to a user of the hearing device, wherein the probability is determined by monitoring a bandwidth of the input acoustic signal and by monitoring at least one of the following criterions:

presence of a telephone dial tone;

behavior of a feedback canceller filter indicating an object being close to an ear; and a magnetic field is present in a T-coil.

5. The method of claim 4, wherein the step of selecting one of the input acoustic signal and the input magnetic signal as the information signal is performed using a state machine.

6. The method claim 5, wherein the state machine comprises at least four states comprising:

an Idle state being a default state;

an DialTone state being representative for detecting dial tone;

a Listen state being representative for receiving acoustic information from a remote person talking via telephone;

a Speak state being representative for speaking to a remote person via telephone.

7. A hearing device comprising:

an acoustic sensor for sensing an acoustic signal and providing an input acoustic signal, a magnetic sensor for sensing a magnetic field signal and providing an input magnetic signal, a telephone detection unit connected to the magnetic sensor for selecting one of the input acoustic signal and the input magnetic signal as an information signal, wherein the telephone detector unit selects the input magnetic signal as the information signal after a telephone detection process has determined a probability being above a preset value, said probability being indicative of a presence of audio information in the input magnetic signal, and an information processing unit for processing the information signal to a user of the hearing device, wherein the probability is determined by monitoring a bandwidth of the input magnetic signal and by monitoring at least one of the following criterions:

presence of a telephone dial tone;

behavior of a feedback canceller filter indicating an object being close to an ear; and a magnetic field is present in a T-coil.

8. The hearing device of claim 7, further comprising a switch unit for operationally connecting either the magnetic sensor or the acoustic sensor to the information processing unit, the switch unit being controllable by the telephone detection unit.

9. The hearing device of claim 7, further comprising a state machine in the telephone detection unit.

10. The hearing device of claim 8, further comprising a state machine in the telephone detection unit.

11. The hearing device of one of the claim 9 or 10, wherein the state machine comprises at least four states comprising:

an Idle state being a default state;

an DialTone state being representative for detecting dial tone;

a Listen state being representative for receiving acoustic information from a remote person talking via telephone; and a Speak state being representative for speaking to a remote person via telephone.

12. A hearing device comprising:

an acoustic sensor for sensing an acoustic signal and providing an input acoustic signal, a magnetic sensor for sensing a magnetic field signal and providing an input magnetic signal, a telephone detection unit connected to the acoustic sensor for selecting one of the input acoustic signal and the input magnetic signal as an information signal, wherein the telephone detector unit selects the input acoustic signal as the information signal after a telephone detection process has determined a probability being above a preset value, said probability being indicative of a presence of audio information in the input acoustic signal, and an information processing unit for processing the information signal to a user of the hearing device, wherein the probability is determined by monitoring a bandwidth of the input acoustic signal and by monitoring at least one of the following criterions:

presence of a telephone dial tone;

behavior of a feedback canceller filter indicating an object being close to an ear; and a magnetic field is present in a T-coil.

13. The hearing device of claim 12, further comprising a switch unit for operationally connecting either the magnetic sensor or the acoustic sensor to the information processing unit, the switch unit being controllable by the telephone detection unit.

14. The hearing device of claim 12, further comprising a state machine in the telephone detection unit.

15. The hearing device of claim 13, further comprising a state machine in the telephone detection unit.

16. The hearing device of one of the claim 14 or 15, wherein the state machine comprises at least four states comprising:

an Idle state being a default state;

an DialTone state being representative for detecting dial tone;

a Listen state being representative for receiving acoustic information from a remote person talking via telephone; and a Speak state being representative for speaking to a remote person via telephone.

* * * * *